US011746977B2

(12) United States Patent
Jin

(10) Patent No.: US 11,746,977 B2
(45) **Date of Patent: *Sep. 5, 2023**

(54) LAMP FOR VEHICLE

(71) Applicant: HYUNDAI MOBIS CO., LTD., Seoul (KR)

(72) Inventor: Min Ji Jin, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/929,250

(22) Filed: Sep. 1, 2022

(65) Prior Publication Data

US 2023/0071713 A1 Mar. 9, 2023

Related U.S. Application Data

(63) Continuation of application No. 17/533,067, filed on Nov. 22, 2021, now Pat. No. 11,536,433.

(30) Foreign Application Priority Data

Sep. 17, 2021 (KR) ..... 10-2021-0124430

(51) Int. Cl.
*F21S 41/25* (2018.01)
*F21S 41/43* (2018.01)
*F21S 41/33* (2018.01)

(52) U.S. Cl.
CPC ..... *F21S 41/25* (2018.01); *F21S 41/334* (2018.01); *F21S 41/43* (2018.01)

(58) Field of Classification Search
None
See application file for complete search history.

(56) References Cited

U.S. PATENT DOCUMENTS

| | | | |
|---|---|---|---|
| 2017/0356614 | A1 | 12/2017 | Park |
| 2019/0086051 | A1 | 3/2019 | Motohashi |
| 2019/0226655 | A1 | 7/2019 | Takeshi |
| 2020/0141554 | A1 | 5/2020 | Chen |
| 2021/0199256 | A1 | 7/2021 | Son |

FOREIGN PATENT DOCUMENTS

| | | |
|---|---|---|
| DE | 10 2014 203 335 | 8/2015 |
| JP | 2012-0164617 | 8/2012 |
| KR | 2019-0025206 | 3/2019 |

(Continued)

OTHER PUBLICATIONS

German Office Action dated May 11, 2022 issued in DE 10 2021 133 335.5.

(Continued)

*Primary Examiner* — Elmito Breval
(74) *Attorney, Agent, or Firm* — DLA PIPER LLP (US)

(57) ABSTRACT

Disclosed is a lens for a vehicle including a light source part including a plurality of light sources that irradiate light, and a lens part that outputs the light irradiated by the light source part to a front side, and the lens part includes a first lens disposed on a front side of the light source part, and a thickness of which becomes smaller as it goes toward opposite sides with respect to a leftward/rightward direction, and a second lens disposed on a front side of the first lens and deflected to be disposed on a more rear side as it goes from one end to an opposite end thereof with respect to the leftward/rightward direction.

17 Claims, 10 Drawing Sheets

(56) References Cited

FOREIGN PATENT DOCUMENTS

| | | |
|---|---|---|
| KR | 2020-0034476 | 3/2020 |
| KR | 2020-0079823 | 7/2020 |
| KR | 2021-0083600 | 7/2021 |

OTHER PUBLICATIONS

English Language Abstract of DE 10 2014 203 335 published Aug. 27, 2015.
Korean Office Action dated Apr. 18, 2023 issued in KR 10-2021-0124430.
English Language Abstract of KR 2020-0034476 published Mar. 31, 2020.
English Language Abstract of KR 2021-0083600 published Jul. 7, 2021.
English Language Abstract of KR 2020-0079823 published Jul. 6, 2020.
English Language Abstract of KR 2019-0025206 published Mar. 11, 2019.
English Language Abstract of JP 2012-0164617 published Aug. 30, 2012.

LAMP FOR VEHICLE

CROSS-REFERENCE TO RELATED APPLICATION

This application is a continuation of U.S. application Ser. No. 17/533,067, filed Nov. 22, 2021, which claims the benefit of priority to Korean Patent Application No. 10-2021-0124430, filed in the Korean Intellectual Property Office on Sep. 17, 2021, the entire contents of each are incorporated herein by reference.

TECHNICAL FIELD

The present disclosure relates to a lamp for a vehicle, and more particularly, to a lamp for a vehicle for minimizing a discontinuity of a lens.

BACKGROUND

In general, a vehicle is equipped with various kinds of lamps having a lighting function for allowing a user to easily identify an object located around a vehicle during nighttime driving and a signal function for informing other vehicles or road users of a driving state of the vehicle.

For example, the vehicle includes headlamps and fog lamps (headlights or front lamps) that mainly perform a lighting function, and turn signal lamps, tail lamps, brake lamps, and side markers that mainly perform a signal function, installation references and standards of the lamps for vehicles are ruled by laws such that the lamps sufficiently show their functions.

Among the lamps for a vehicle, a headlamp that forms a low beam pattern or a high beam pattern to secure a front field of view of a driver plays a very important role in safe driving.

Meanwhile, in recent years, importance of external designs of headlamps and light distribution patterns, as well as a performance of the headlamps has been emphasized. Accordingly, recently, slim lenses having wide shapes have been used.

However, existing lenses having wide shapes are designed to be separated to an area that forms a short-distance light distribution pattern and a long-distance light distribution pattern. Because the areas of the lens are designed to from different focuses according to the characteristics of the areas, a discontinuous image is caused by a difference of the shapes of the areas of the lens, and thus a design defect may be caused.

Accordingly, an optical system that may provide a continuous image without causing a discontinuity for differentiation in a design aspect of the lamp for a vehicle is necessary.

SUMMARY

The present disclosure has been made to solve the above-mentioned problems occurring in the prior art while advantages achieved by the prior art are maintained intact.

An aspect of the present disclosure provides a lamp for a vehicle that may minimize a discontinuity due to a stepped portion in the slim lamp.

An aspect of the present disclosure also provides a lamp for a vehicle that may implement differentiation in a design aspect by implementing a continuity of a lens at a slim height portion, and thus enhances a competitiveness of the product.

The technical problems to be solved by the present disclosure are not limited to the aforementioned problems, and any other technical problems not mentioned herein will be clearly understood from the following description by those skilled in the art to which the present disclosure pertains.

According to an embodiment, a lens for a vehicle includes a light source part including a plurality of light sources that irradiate light, and a lens part that outputs the light irradiated by the light source part to a front side, and the lens part includes a first lens disposed on a front side of the light source part, and a second lens disposed on a front side of the first lens and deflected to be disposed on a more rear side as it goes from one end to an opposite end thereof with respect to the leftward/rightward direction, and the light source part includes a plurality of first light sources configured to form a first light distribution pattern and a plurality of second light sources configured to form a second light distribution pattern having characteristics that are different from those of the first light distribution pattern, and the first light distribution pattern and the second light distribution pattern overlap each other to form a low beam pattern.

The lens part may form a single focus with the first lens and the second lens.

A thickness of the first lens is smaller as it goes toward opposite sides with respect to a leftward/rightward direction and, a leftward/rightward width of the first lens may be the same as a leftward/rightward width of the second lens.

The second lens may become closer to the light source part as it goes from a central portion to an outside of the vehicle.

A horizontal curvature of an input surface of the first lens may be smaller than a horizontal curvature of an output surface of the first lens.

A vertical curvature of an input surface of the first lens may be smaller than a vertical curvature of an output surface of the first lens.

A horizontal curvature and a vertical curvature of an input surface of the first lens may be different, and a horizontal curvature and a vertical curvature of an output surface of the first lens may be different.

A horizontal curvature of an input surface of the second lens may be smaller than a horizontal curvature of an output surface of the second lens, and a vertical curvature of an input surface of the second lens may be the same as a vertical curvature of an output surface of the second lens.

A horizontal curvature and a vertical curvature of an input surface of the second lens may be different, and a horizontal curvature and a vertical curvature of an output surface of the second lens may be different.

A thickness of the second lens in a direction that faces an output surface from an input surface may be uniform over an entire area thereof.

The lens may further include a reflector array, in which a plurality of reflectors that reflect the light irradiated by the plurality of light sources are coupled to each other.

the second light sources are disposed at locations that are more distant from an optical axis of the light source part than those of the first light sources, and a size of light emitting surfaces of the first light sources may be smaller a size of light emitting surfaces of the second light sources.

The reflector array may include a plurality of first reflectors that reflects the light irradiated by the plurality of first light sources, and a plurality of second reflectors that reflects the light irradiated by the plurality of second light sources, and a first reflection distance (L1) that is a distance from the light emitting surfaces of the first light sources to a reflection surface of the first reflector may be larger than a second reflection distance (L2) that is a distance from the light emitting surfaces of the second light sources to a reflection surface of the second reflector.

Each of the first lens and the second lens may include inclined surfaces formed on an upper surface and a lower surface thereof to form the upper surface and the lower surface convexly.

The upper surface of the first lens may include a first upper inclined surface extending from an upper end of an input surface and inclined upwards, and a second upper inclined surface inclined downwards from the first upper inclined surface toward an output surface, and the lower surface of the first lens may include a first lower inclined surface extending from a lower end of the input surface and inclined downwards, and a second lower inclined surface inclined upwards from the first lower inclined surface toward the output surface.

The upper surface of the second lens may include a first upper slope surface extending from an upper end of an input surface and inclined upwards, and a second upper slope surface inclined downwards from the first upper slope surface toward an output surface, and the lower surface of the second lens may include a first lower slope surface extending from a lower end of the input surface and inclined downwards, and a second lower slope surface inclined upwards from the first lower slope surface toward the output surface.

The lens may further include a shield part disposed between the light source part and the lens part, and that shields a portion of the light irradiated by the light source part, and the shield part may be disposed at a focus of the lens part.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Hereinafter, embodiments of the present disclosure will be described in detail with reference to the accompanying drawings.

First, the embodiments described herein are embodiments that are suitable for understanding the technical features of a lamp for a vehicle according to the present disclosure. However, the present disclosure is not limited to the embodiment described below or the technical features of the present disclosure are not limited by the described embodiments, and the present disclosure may be variously modified without departing from the technical scope of the present disclosure.

Figure 1:
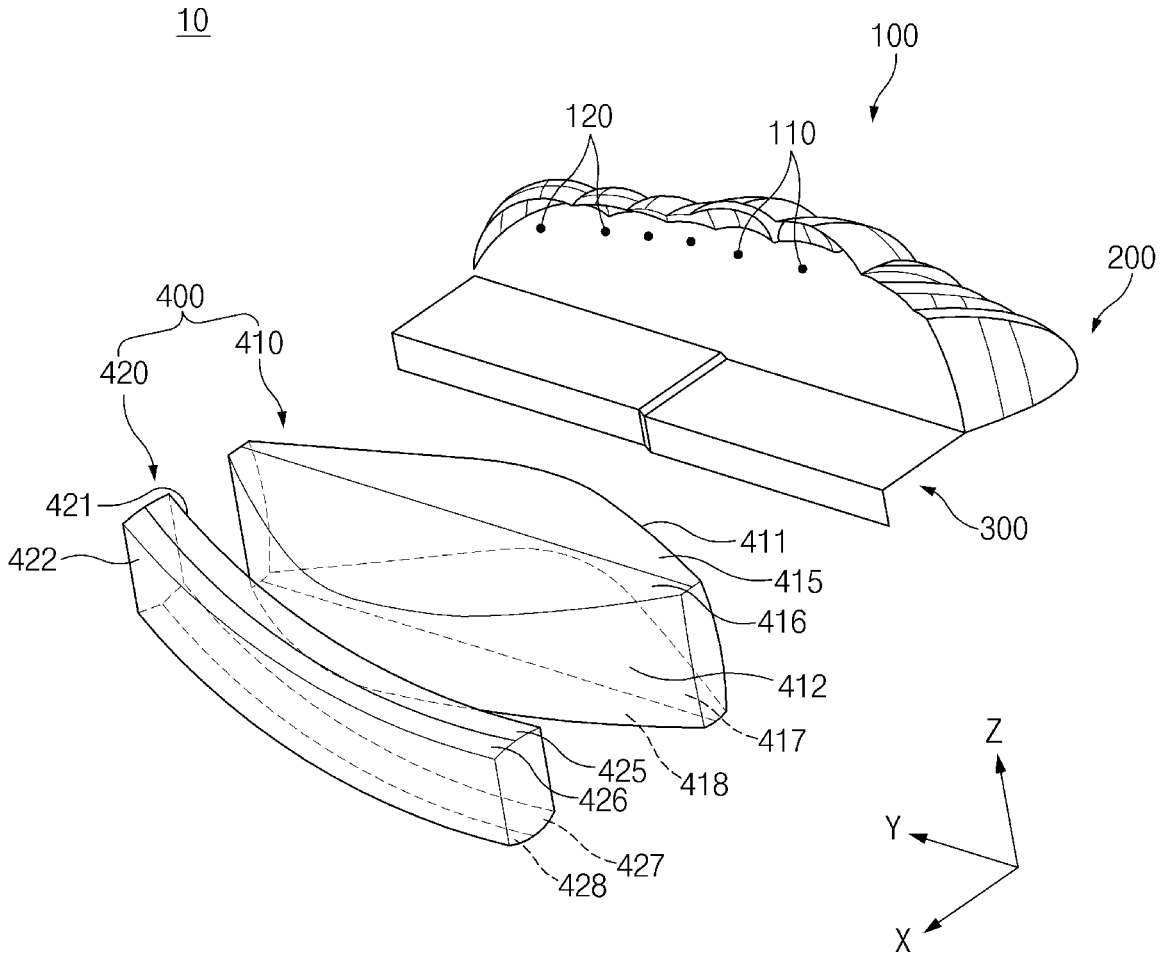
FIG. 1 is a perspective view illustrating a lamp for a vehicle according to an embodiment of the present disclosure.
Figure 2:
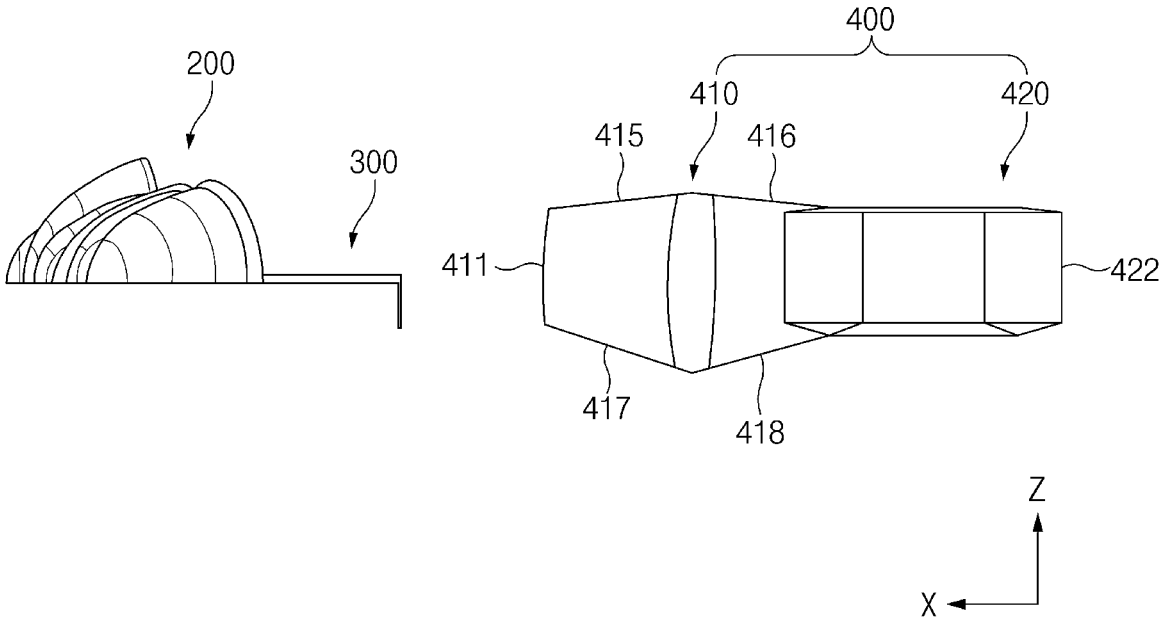
FIG. 2 is a side view illustrating a side surface of a lamp for a vehicle according to an embodiment of the present disclosure.
Figure 3:
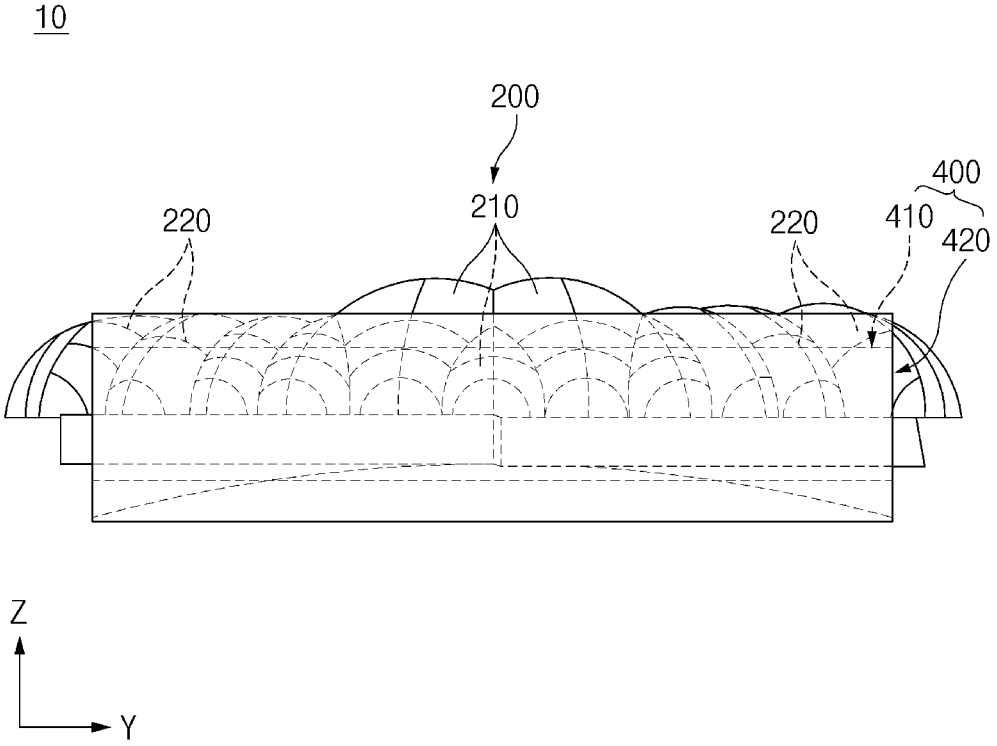
FIG. 3 is a front view illustrating a lamp for a vehicle according to an embodiment of the present disclosure.
Figure 4:
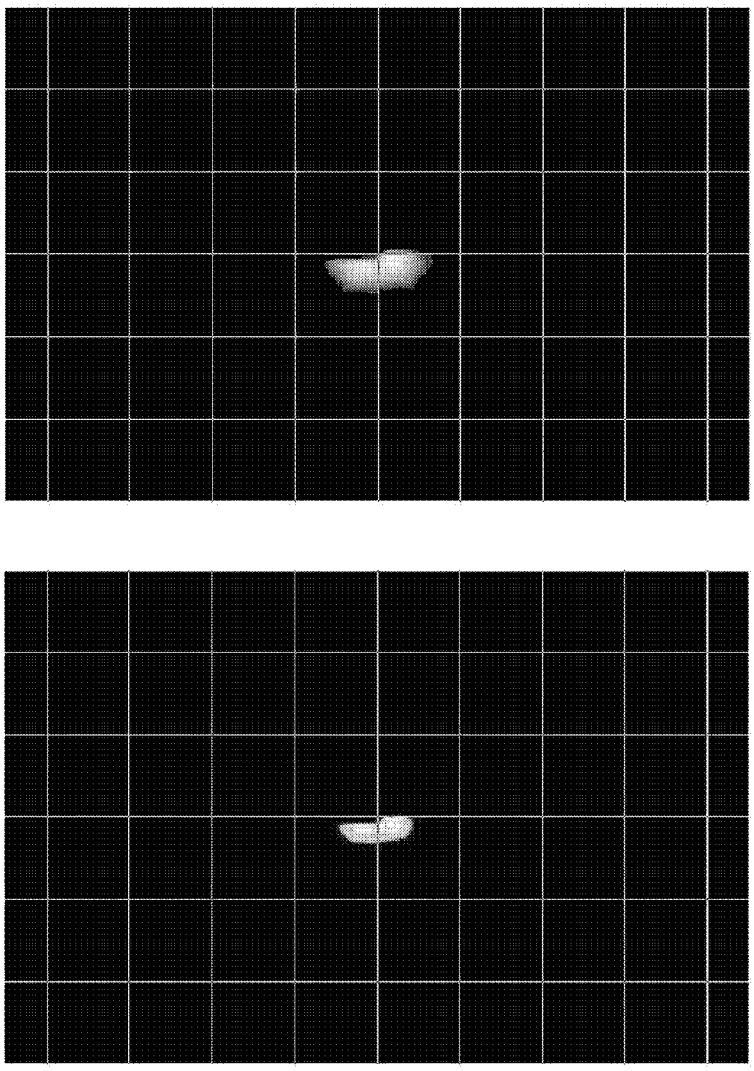
FIG. 4 is a view illustrating a first light distribution pattern of a lamp for a vehicle according to an embodiment of the present disclosure.
Figure 5:
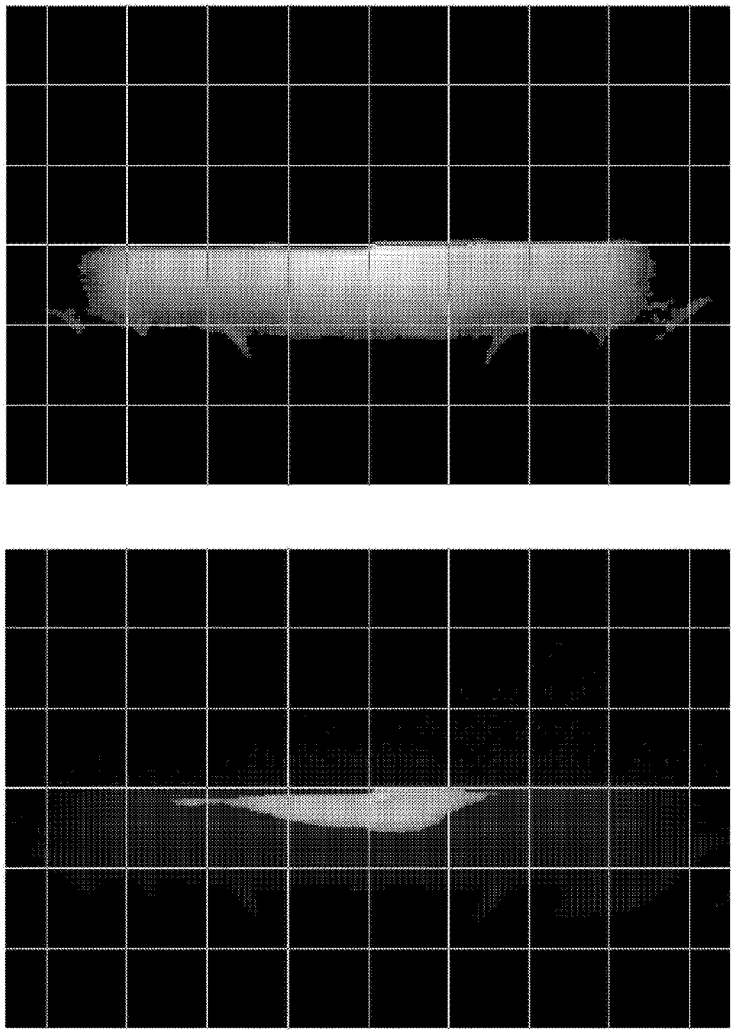
FIG. 5 is a view illustrating a second light distribution pattern of a lamp for a vehicle according to an embodiment of the present disclosure.
Figure 6:
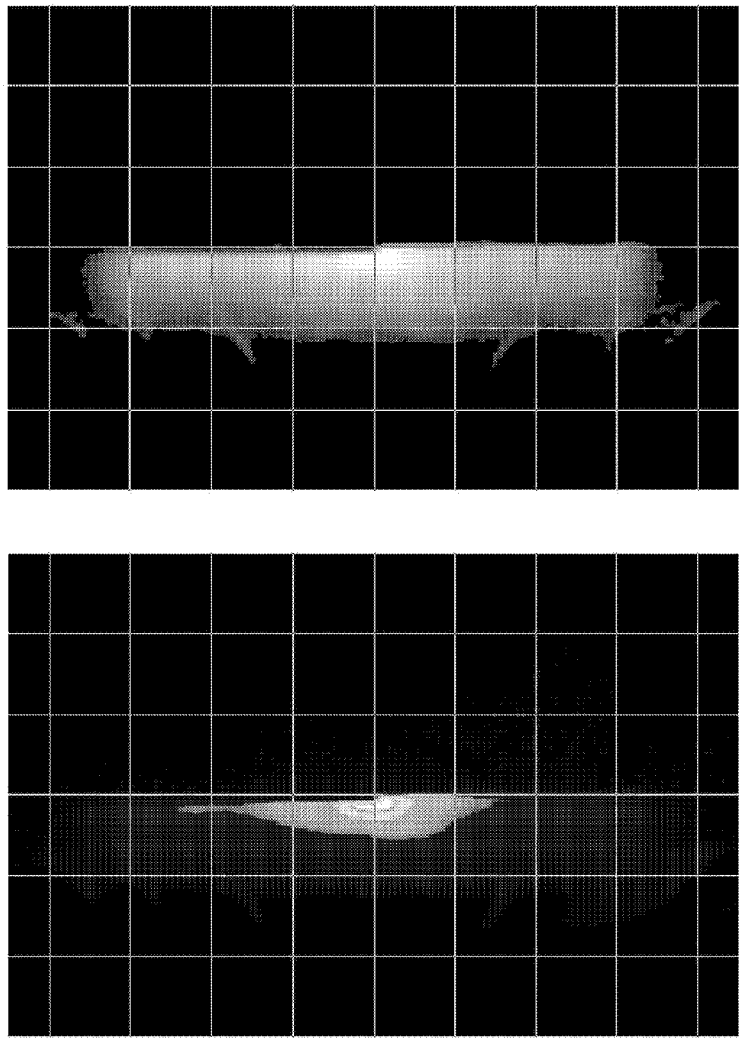
FIG. 6 is a view illustrating a low beam pattern of a lamp for a vehicle according to an embodiment of the present disclosure.
Figure 7:
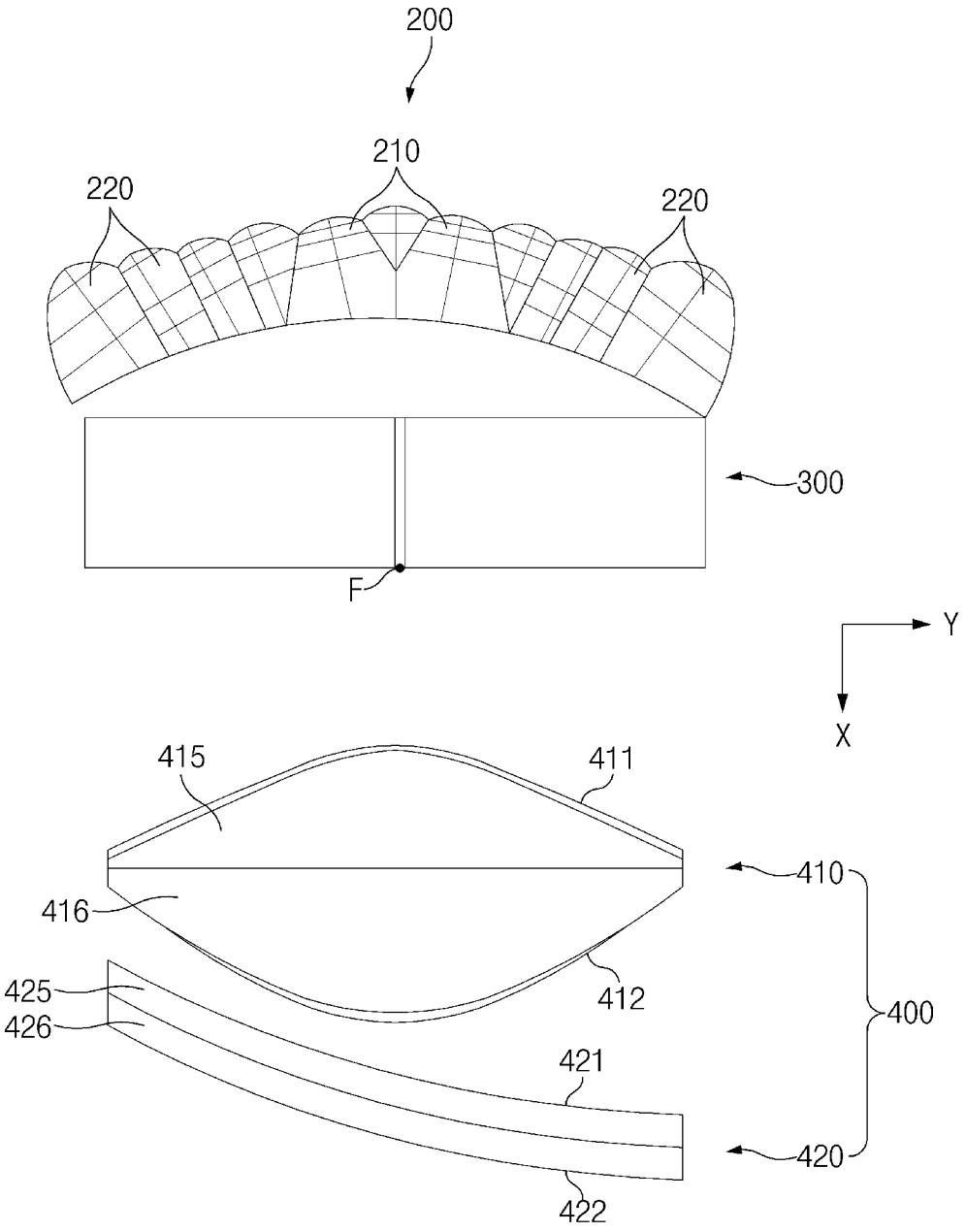
FIG. 7 is a view illustrating a lamp for a vehicle according to an embodiment of the present disclosure, when viewed from a top.
Figure 9:
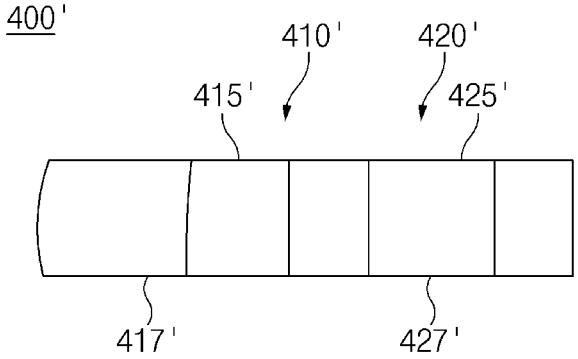
FIG. 9 is a side view illustrating a lens part according to a comparative example of the present disclosure.
Figure 10:
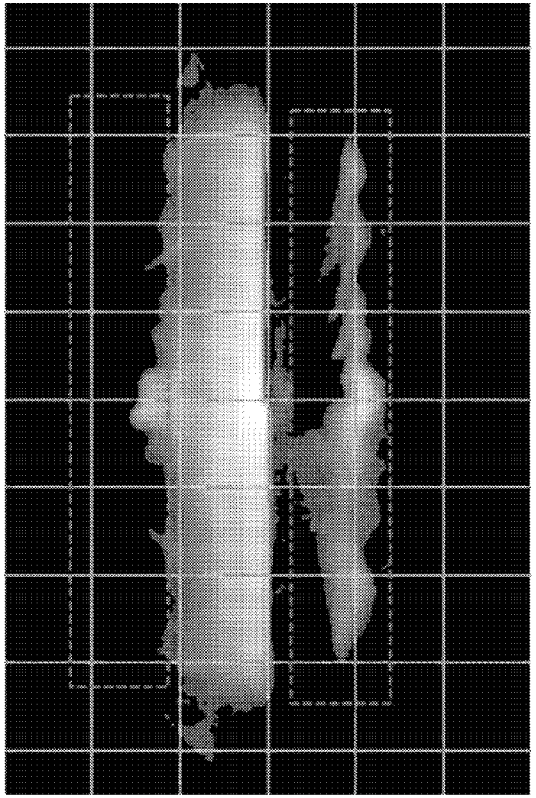
FIG. 10 is a view illustrating a light distribution pattern of a lamp for a vehicle according to an embodiment of the present disclosure.

FIG. 1 is a perspective view illustrating a lamp for a vehicle according to an embodiment of the present disclosure. FIG. 2 is a side view illustrating a side surface of a lamp for a vehicle according to an embodiment of the present disclosure. FIG. 3 is a front view illustrating a lamp for a vehicle according to an embodiment of the present disclosure. FIG. 4 is a view illustrating a first light distribution pattern of a lamp for a vehicle according to an embodiment. FIG. 4 is a view illustrating a second light distribution pattern of a lamp for a vehicle according to an embodiment. FIG. 6 is a view illustrating a low beam pattern of a lamp for a vehicle according to an embodiment of the present disclosure. FIG. 7 is a view illustrating a lamp for a vehicle according to an embodiment of the present disclosure, when viewed from a top. FIG. 7 is a view illustrating a lamp for a vehicle according to an embodiment of the present disclosure, and is a view additionally illustrating a travel path of light output from a light source in FIG. 7. FIG. 9 is a side view illustrating a lens part according to a comparative example of the present disclosure. FIG. 10 is a view illustrating a light distribution pattern of a lamp for a vehicle according to an embodiment of the present disclosure.

Referring to FIGS. 1 to 8, a lamp 10 for a vehicle according to an embodiment of the present disclosure includes a light source part 100 and a lens part 400. Furthermore, the lamp 10 for a vehicle according to the embodiment of the present disclosure may further include a shield part 300 and a reflector array 200.

The light source part 100 includes a plurality of light sources that irradiate light.

Here, the light sources may be various elements or devices that may emit light. For example, the light sources may be light emitting diodes (hereinafter, referred to as LEDs), but the present disclosure is not limited thereto and may be various lamps such as laser diodes, bulbs, halogen lamps, or xenon lamps (HID).

The light source part 100 may include a plurality of light sources, and the number and the arrangement of the light sources may be determined according to a design specification of the lamps. For example, the plurality of light sources may be disposed in an arc shape with respect to a leftward/rightward direction. However, the arrangement of the plurality of light sources is not limited thereto.

In more detail, the light source part 100 may include a first light source 110 and a second light source 120.

A plurality of first light sources 110 may be provided to form a first light distribution pattern. A plurality of second light sources 120 may be provided to form a second light distribution pattern having characteristics that are different from those of the first light distribution pattern, and may be disposed at locations that are more distant from an optical axis AX of the light source part 100 than those of the first light sources 110. Here, the optical axis AX may be an optical axis AX formed by an optical system including the light source part 100 and the lens part 400.

The first light distribution pattern and the second light distribution pattern may overlap each other to form a low beam pattern, and a size of light emitting surfaces of the first light sources 110 may be smaller than a size of light emitting surfaces of the second light sources 120.

Here, an aspect that the first light distribution pattern and the second light distribution pattern have different characteristics means that pattern images of light irradiated by the first light sources 110 and the second light sources 120 and output by the lens part 400 are different. For example, this may be implemented by differences of the sizes of the light emitting surfaces of the first light source 110 and the second light source 120, and intervals between the light sources and the reflector array 200.

For example, the first light distribution pattern implemented by the first light sources 110 may be a light distribution pattern (a hot zone) for securing a field of view of a central area of a front side (see FIG. 4). Furthermore, the second light distribution pattern implemented by the second light sources 120 may be a light distribution pattern (a wide zone) for securing a field of view of a peripheral area of a front side and a visibility during rotation (see FIG. 5). Furthermore, the first light distribution pattern and the second light distribution pattern may be integrated to form the low beam pattern (see FIG. 6).

Furthermore, for example, the size of the light emitting surfaces of the first light sources 110 may be smaller than the size of the light emitting surfaces of the second light sources 120. Furthermore, the first light sources 110 may be disposed at locations that are closer to the optical axis AX than the second light sources 120. That is, the second light sources 120 may be disposed on leftward/rightward outer sides of the first light sources 110. Accordingly, the light sources, a light source having a smaller light emitting surface may be disposed to be closer to the optical axis AX.

The lens part 400 is configured to output the light irradiated by the light source part 100 to a front side. The lens part 400 includes a first lens 410 and a second lens 420. Hereinafter, for convenience of description, a horizontal direction that is perpendicular to an optical axis direction (the X axis direction) will be referred to as a leftward/rightward direction (the Y axis direction), and a direction that is perpendicular to both of the optical axis direction (the X axis direction) and the leftward/rightward direction (the Y axis direction) will be referred to as a vertical direction (the Z axis direction).

The first lens 410 may be disposed on a front side of the light source part 100, and may become thinner as it goes toward opposite directions with respect to the leftward/rightward direction. In detail, both of an input surface 411 and an output surface 412 of the first lens 410 may have convex spherical surfaces, and accordingly, a thickness of the first lens 410 in the direction of the optical axis AX may be smaller as it becomes more distant from the optical axis AX. For example, the first lens 410 may be symmetrical in the leftward/right direction with respect to the optical axis AX.

The second lens 420 may be disposed on a front side of the first lens 410, and may be deflected to be disposed on a more rear side as it goes from one end to an opposite end thereof with respect to the leftward/rightward direction.

In detail, the second lens 420 may be deflected to become closer to the light source part 100 as it goes from one end to an opposite end thereof in the leftward/rightward direction, and accordingly, the second lens 420 may be asymmetrical in the leftward/rightward direction with respect to the optical axis AX. Here, the second lens 420 may be deflected and be continuous without a stepped portion. Because the second lens 420 that is disposed on a front side and forms an external appearance of the lamp 10 for a vehicle, the lamp 10 for a vehicle according to the present disclosure may be differentiated in an aspect of design.

For example, the lamp 10 for a vehicle according to the present disclosure may be installed on left and right sides of the vehicle, and the second lens 420 may become closer to the light source part 100 as it goes from a central portion to an outside of the vehicle. That is, the second lens 420 may be deflected toward a rear side as it goes from an inboard to an outboard of the vehicle.

Furthermore, the lens part 400 may form a single focus F with the first lens 410 and the second lens 420. Accordingly, a discontinuity that is formed when shapes of the first lens 410 and the second lens 420 are different or they are stepped may be prevented.

For example, the lens part may be designed to form different focuses in respective areas when it is designed to be separated into an area for forming the first light distribution pattern and an area for forming the second light distribution pattern, and accordingly, border surfaces may be formed for the areas and thus a discontinuous image may be formed. In this case, a design defect of the lamp may be caused. Because the present disclosure is designed to form a single focus with the lens part 400, a continuous image may be implemented by the lens part 400, and thus a design of the external appearance of the lamp may be enhanced.

Meanwhile, a leftward/rightward width of the first lens 410 may be the same as a leftward/rightward width of the second lens 420. This may guarantee a continuous image of the lens part 400. However, the leftward/rightward widths of the first lens 410 and the second lens 420 are not limited to the same width, but for example, the leftward/rightward width of the second lens 420 may be larger than the leftward/rightward width of the first lens 410.

A horizontal curvature of the input surface 411 of the first lens 410 may be smaller than a horizontal curvature of the output surface 412 of the first lens 410. Hereinafter, the horizontal curvature means a curvature in a Y axis direction that is the leftward/rightward direction. Furthermore, a vertical curvature means a curvature in a Z axis direction.

In detail, the first lens 410 may be configured such that a horizontal radius of curvature of the input surface 411 is larger than a horizontal radius of curvature of the output surface 412. In this way, a thickness of the first lens 410 may be minimized because a curvature of the input surface 411 with respect to the leftward/rightward direction is smaller than a curvature of the output surface 412.

Furthermore, a vertical curvature of the input surface 411 of the first lens 410 may be larger than a vertical curvature of the output surface 412 of the first lens 410.

In detail, the first lens 410 may be configured such that a vertical radius of curvature of the input surface 411 is smaller than a vertical radius of curvature of the output surface 412. Accordingly, distortion of an image of the first lens 410 may be minimized even at a low height.

Furthermore, the horizontal curvature and the vertical curvature of the input surface 411 of the first lens 410 may be different, and the horizontal curvature and the vertical curvature of the output surface 412 of the first lens 410 may be different. That is, the horizontal curvatures and the vertical curvatures of the input surface 411 and the output surface 412 of the first lens 410 may be different. Accordingly, the first lens 410 may be minimized.

Meanwhile, a horizontal curvature of the input surface 411 of the second lens 420 may be the same as a horizontal curvature of the output surface 412 of the second lens 420. Furthermore, a vertical curvature of the input surface 411 of the second lens 420 may be the same as a vertical curvature of the output surface 412 of the second lens 420.

In detail, the first lens 410 may have optical characteristics of changing a travel direction of the light to form a specific light distribution pattern, whereas the second lens 420 may be a lens that outputs the light that passed through the first lens 410 after the light is input and may be a lens that determines an external design shape of the lamp 10 for a vehicle. Accordingly, the horizontal curvatures of the input surface 421 and the output surface 422 of the second lens 420 may be the same, and the vertical curvatures of the input surface 421 and the output surface 422 of the second lens 420 may be the same.

Furthermore, the horizontal curvature and the vertical curvature of the input surface 421 of the second lens 420 may be different. Furthermore, the horizontal curvature and the vertical curvature of the output surface 422 of the second lens 420 may be different. That is, the horizontal curvatures and the vertical curvatures of the input surface 421 and the output surface 422 of the second lens 420 may be different.

A thickness of the second lens 420 in a direction that faces the output surface 422 from the input surface 421 may be uniform over an entire area. As described above, because the second lens 420 that forms the external appearance of the lamp is uniform in the entire area, the external appearance of the lamp 10 for a vehicle according to the present disclosure may implement a continuous image.

Here, the uniform thickness does not mean only a case in which the thickness of the second lens 420 in the direction that faces the output surface 422 from the input surface 421 is perfectly the same in the entire area. For example, a thickness difference within a tolerance (for example, within about 2 mm) that is caused in a manufacturing process by an ordinary person in the art, to which the present disclosure pertains, may be regarded as a uniform thickness.

Because the first lens 410 and the second lens 420 have the above-described curvatures, the sizes of the lenses may be minimized, and accordingly, a continuous image may be implemented while the lamp 10 for a vehicle may be made small.

Meanwhile, as described above, the light source part 100 may include the first light sources 110 that form the first light distribution pattern (the hot zone) for securing the field of view of the central area on the front side, and the second light sources 120 that form the second light distribution pattern (the wide zone) for securing the field of view of the peripheral area and the visibility on the front side. Furthermore, the first light distribution pattern and the second light distribution pattern may overlap each other to form the low beam pattern.

Here, the size of the light emitting surfaces of the first light sources 110 may be smaller than the size of the light emitting surfaces of the second light sources 120.

That is, the size of the first light sources 110 for forming the first light distribution pattern (the hot zone) may be smaller than the size of the second light sources 120 for forming the second light distribution pattern (the wide zone). Accordingly, the first light sources 110 having the small light emitting surfaces may be disposed to be closer to the optical axis AX, and the second light sources 120 having the large light emitting surfaces may be disposed to be distant from the optical axis AX. Through the sizes and disposition of the light sources, the first light distribution pattern and the second light distribution pattern may be formed.

Meanwhile, the present disclosure may further include the reflector array 200. In the reflector array 200, a plurality of reflectors configured to reflect the light irradiated by the plurality of light sources may be coupled to each other.

For example, the plurality of light sources may be disposed in an arc shape with respect to the leftward/rightward direction. Furthermore, in the reflector array 200, among the reflectors, a reflector that is disposed to be more distant from the optical axis may be closer to the lens part 400.

Here, the reflector array 200 may include a plurality of first reflectors 210 that reflect the light irradiated by the plurality of first light sources 110, and a plurality of second reflectors 220 that reflect the light irradiated by the plurality of second light sources 120. In detail, the first reflectors 210 may form the first light distribution pattern together with the first light sources 110, and the second reflectors 220 may form the second light distribution pattern together with the second light sources 120.

Figure 8:
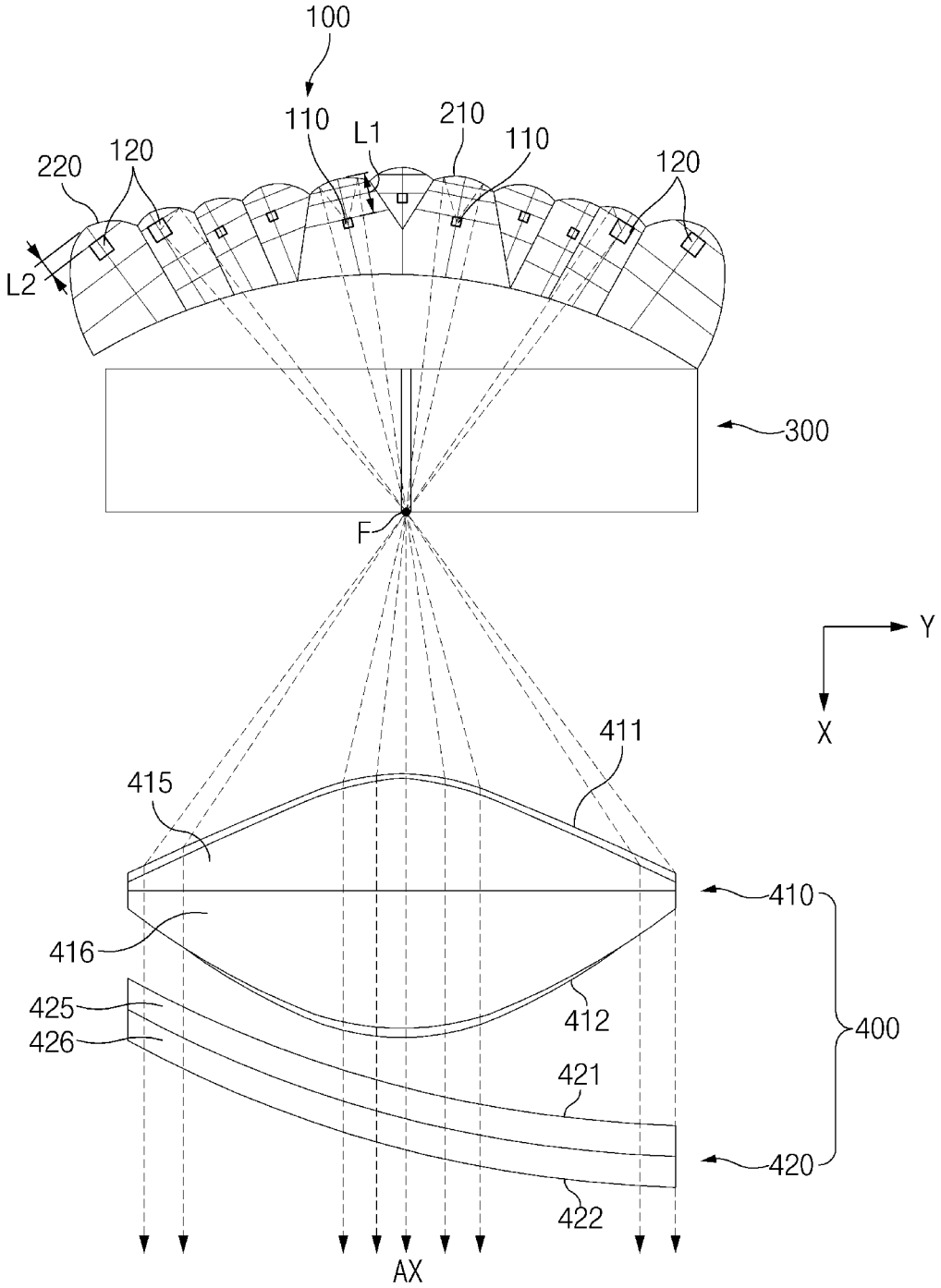
FIG. 8 is a view illustrating a lamp for a vehicle according to an embodiment of the present disclosure, and is a view additionally illustrating a travel path of light output from a light source in FIG. 7.

Here, referring to FIG. 8, a first reflection distance L1 that is a distance from the light emitting surfaces of the first light sources 110 to reflection surfaces of the first reflectors 210 is larger than a second reflection distance L2 that is a distance from the light emitting surfaces of the second light sources 120 to reflection surfaces of the second reflectors 220. In detail, the first reflectors 210 for forming the first light distribution pattern may be shaped such that the reflection surfaces thereof are closer to the light sources than the second reflectors 220 for forming the second light distribution pattern. Accordingly, the first light distribution pattern and the second light distribution pattern may have different characteristics.

Meanwhile, referring to FIGS. 1 and 2, the first lens 410 and the second lens 420 may include inclined surfaces on the upper surfaces and the lower surfaces thereof such that the upper surfaces and the lower surfaces are convex.

In detail, the upper surface of the first lens 410 may include a first upper inclined surface 415 extending from an upper end of the input surface 411 and inclined upwards, and a second upper inclined surface 416 inclined downwards from the first upper inclined surface 415 toward the output surface 412. In detail, the lower surface of the first lens 410 may include a first lower inclined surface 417 extending from a lower end of the input surface 417 and inclined downwards, and a second lower inclined surface 418 inclined upwards from the first lower inclined surface 417 toward the output surface 412.

Accordingly, surfaces having slopes may be applied to the upper surface and the lower surface of the first lens 410.

Furthermore, the upper surface of the second lens 420 may include a first upper slope surface 425 extending from the upper end of the input surface 421 and inclined upwards, and a second upper slope surface 426 inclined downwards from the first upper slope surface 425 toward the output surface 422. In detail, the lower surface of the first lens 410 may include a first lower slope surface 427 extending from the lower end of the input surface 421 and inclined downwards, and a second lower slope surface 428 inclined upwards from the first lower slope surface 427 toward the output surface 422.

Accordingly, surfaces having slopes may be applied to the upper surface and the lower surface of the second lens 420. In this way, by applying the slopes of specific angles by using the inclined surfaces formed on the upper surfaces and the lower surfaces of the first lens 410 and the second lens 420, a light leak phenomenon on the upper surfaces and the lower surfaces of the first lens 410 and the second lens 420 may be minimized. In detail, because the first lens 410 and the second lens 420 are thick, a light leak phenomenon by surface reflection thereof may be minimized when the slopes are applied to the upper surfaces and the lower surfaces thereof.

For example, as in a lens part 400' according to the comparative example illustrated in FIGS. 9 and 10, when an upper surface 415' and a lower surface 417' of a first lens 410' and an upper surface 425' and a lower surface 427' of a second lens 420' are formed flat, many light leaks may be caused by the surface reflection due to the large thicknesses of the first lens 410' and the second lens 420'. A dotted line area of FIG. 10 is an area caused by the light leak phenomenon. Due to the light leak phenomenon, a quality of the lamp for a vehicle may be decreased.

Accordingly, the present disclosure may correct the light leak phenomenon and enhance the quality of the product by forming convex inclined surfaces on the upper surface and the lower surfaces or the first lens 410 and the second lens 420.

Meanwhile, the present disclosure may further include the shield part 300. The shield part 300 may be disposed between the light source part 100 and the lens part 400, and may be configured to shield a portion of the light irradiated by the light source part 100. Here, the shield part 300 may be disposed at a focus "F" of the lens part 400. Furthermore, due to the shape of the shield part, a cutoff line may be formed in the low beam pattern.

According to the lamp for a vehicle according to the embodiment of the present disclosure, because a single focus is formed by the first lens and the second lens and the second lens forming the external appearance of the lamp is continuous, a discontinuity due to a stepped shape in the slim lamp may be minimized.

Accordingly, according to the embodiment of the present disclosure, because the continuity of the lens may be implemented at a slim height portion, a design differentiation may be possible, and accordingly, a competitiveness of the product may be enhanced.

Although the specific embodiments of the present disclosure have been described until now, the spirit and scope of the present disclosure are not limited to the specific embodiments, and may be variously corrected and modified by an ordinary person in the art, to which the present disclosure pertains, without changing the essence of the present disclosure claimed in the claims.

What is claimed is:

1. A lens for a vehicle comprising:

a light source part including a plurality of light sources that irradiate light; and a lens part configured to output the light irradiated by the light source part to a front side, wherein the lens part includes:

a first lens disposed on a front side of the light source part; and a second lens disposed on a front side of the first lens and deflected to be disposed on a more rear side as it goes from one end to an opposite end thereof with respect to a leftward/rightward direction, wherein the light source part includes:

a plurality of first light sources configured to form a first light distribution pattern; and a plurality of second light sources configured to form a second light distribution pattern having characteristics that are different from those of the first light distribution pattern, wherein the first light distribution pattern and the second light distribution pattern overlap each other to form a low beam pattern.

2. The lens of claim 1, wherein the lens part forms a single focus with the first lens and the second lens.

3. The lens of claim 1, wherein a thickness of the first lens is smaller as it goes toward opposite sides with respect to a leftward/rightward direction, and a leftward/rightward width of the first lens is the same as a leftward/rightward width of the second lens.

4. The lens of claim 1, wherein the second lens becomes closer to the light source part as it goes from a central portion to an outside of the vehicle.

5. The lens of claim 1, wherein a horizontal curvature of an input surface of the first lens is smaller than a horizontal curvature of an output surface of the first lens.

6. The lens of claim 1, wherein a vertical curvature of an input surface of the first lens is smaller than a vertical curvature of an output surface of the first lens.

7. The lens of claim 1, wherein a horizontal curvature and a vertical curvature of an input surface of the first lens are different, and a horizontal curvature and a vertical curvature of an output surface of the first lens are different.

8. The lens of claim 1, wherein a horizontal curvature of an input surface of the second lens is smaller than a horizontal curvature of an output surface of the second lens, and a vertical curvature of an input surface of the second lens is the same as a vertical curvature of an output surface of the second lens.

9. The lens of claim 1, wherein a horizontal curvature and a vertical curvature of an input surface of the second lens are different, and a horizontal curvature and a vertical curvature of an output surface of the second lens are different.

10. The lens of claim 1, wherein a thickness of the second lens in a direction that faces an output surface from an input surface is uniform over an entire area thereof.

11. The lens of claim 1, further comprising:

a reflector array, in which a plurality of reflectors configured to reflect the light irradiated by the plurality of light sources are coupled to each other.

12. The lens of claim 11, wherein the second light sources are disposed at locations that are more distant from an optical axis of the light source part than those of the first light sources, wherein a size of light emitting surfaces of the first light sources is smaller a size of light emitting surfaces of the second light sources.

13. The lens of claim 12, wherein the reflector array includes:

a plurality of first reflectors configured to reflect the light irradiated by the plurality of first light sources; and a plurality of second reflectors configured to reflect the light irradiated by the plurality of second light sources, and wherein a first reflection distance (L1) that is a distance from the light emitting surfaces of the first light sources to a reflection surface of the first reflector is larger than a second reflection distance (L2) that is a distance from the light emitting surfaces of the second light sources to a reflection surface of the second reflector.

14. The lens of claim 1, wherein each of the first lens and the second lens includes:

inclined surfaces formed on an upper surface and a lower surface thereof to form the upper surface and the lower surface convexly.

15. The lens of claim 14, wherein the upper surface of the first lens includes:

a first upper inclined surface extending from an upper end of an input surface and inclined upwards; and a second upper inclined surface inclined downwards from the first upper inclined surface toward an output surface, and wherein the lower surface of the first lens includes:

a first lower inclined surface extending from a lower end of the input surface and inclined downwards; and a second lower inclined surface inclined upwards from the first lower inclined surface toward the output surface.

16. The lens of claim 14, wherein the upper surface of the second lens includes:

a first upper slope surface extending from an upper end of an input surface and inclined upwards; and a second upper slope surface inclined downwards from the first upper slope surface toward an output surface, and wherein the lower surface of the second lens includes:

a first lower slope surface extending from a lower end of the input surface and inclined downwards; and a second lower slope surface inclined upwards from the first lower slope surface toward the output surface.

17. The lens of claim 1, further comprising:

a shield part disposed between the light source part and the lens part, and configured to shield a portion of the light irradiated by the light source part, and wherein the shield part is disposed at a focus of the lens part.

* * * * *